US012740622B1

(12) United States Patent
Tao

(10) Patent No.: US 12,740,622 B1
(45) Date of Patent: Sep. 22, 2026

(54) MULTIFUNCTIONAL PENDANT AND NECKLACE

(71) Applicant: Dongguan Qinshi Jewelry Co., Ltd., Dongguan (CN)

(72) Inventor: Wei Tao, Yiyang (CN)

( * ) Notice: Subject to any disclaimer, the term of this patent is extended or adjusted under 35 U.S.C. 154(b) by 0 days.

(21) Appl. No.: 19/265,331

(22) Filed: Jul. 10, 2025

(30) Foreign Application Priority Data

Jun. 19, 2025 (CN) ..... 202521266227.0

(51) Int. Cl.
*A44C 15/00* (2006.01)

(52) U.S. Cl.
CPC ..... *A44C 15/002* (2013.01); *A44C 15/005* (2013.01)

(58) Field of Classification Search
CPC ... A44C 25/001; A44C 25/002; A44C 25/004; A44C 15/002; A44B 15/005; Y10S 63/02
USPC ..... 63/1.15
See application file for complete search history.

(56) References Cited

U.S. PATENT DOCUMENTS

| | | | | |
|---|---|---|---|---|
| 10,342,315 | B2 * | 7/2019 | Maehr | A44C 15/005 |
| 2016/0082140 | A1 * | 3/2016 | Chen | A45D 34/02 239/44 |
| 2017/0295893 | A1 * | 10/2017 | D'Alessandro | A44C 15/002 |
| 2020/0015556 | A1 * | 1/2020 | Mouraret | A01M 1/2044 |

FOREIGN PATENT DOCUMENTS

| | | | |
|---|---|---|---|
| CN | 217658478 | U | 10/2022 |
| JP | 1994038628 | U | 5/1994 |

* cited by examiner

*Primary Examiner* — Jack W Lavinder
(74) *Attorney, Agent, or Firm* — Nitin Kaushik

(57) ABSTRACT

Disclosed are a multifunctional pendant and a necklace. The pendant includes an outer member, an elastic member received within the outer component, an inner member with a through-hole, and a guiding and limiting structure. The inner member includes a rod partially accommodated in the outer member. The rod includes a shoulder abutting against the elastic member and a spoon-shaped portion arranged at an end of the rod. The guiding and limiting structure includes a groove and a protrusion slidable in the groove. One of the protrusion and the groove is arranged on an inner wall of the outer member, and the other is arranged on a sidewall of the rod. The spoon-shaped part is out of the outer member when the protrusion is at a higher position of the groove, and retracted into the outer member when the protrusion is at a lower position of the groove.

18 Claims, 8 Drawing Sheets

MULTIFUNCTIONAL PENDANT AND NECKLACE

CROSS-REFERENCE TO RELATED APPLICATIONS

This application claims the priority of the Chinese patent application No. 202521266227.0, filed on Jun. 20, 2025. The disclosure of the aforementioned application is incorporated in this application by reference in its entirety.

TECHNICAL FIELD

The present application relates to ornaments, in particular to a multifunctional pendant and a necklace using the multifunctional pendant.

BACKGROUND

The pendant is an ornament attached to a necklace worn around the neck, crafted with materials such as gold, silver, white gold, diamonds, zircon, jade, crystal, etc. However, an ordinary pendant can only be used as an ornament and serves no other purposes.

Currently, pendants those also serve as perfume holders have come into being. Perfume-holding cotton is placed inside the pendants and the pendants emit fragrant aroma, which is pleasant to people.

Although the pendant can function as a perfume holder and emit aroma from the perfume inside, it still has insufficient functions and fails to meet the needs of users in different scenarios.

SUMMARY

The present application is to provide a multifunctional pendant and a necklace.

The multifunctional pendant provided by the embodiments of the present application includes:

- an outer member;
- an elastic member accommodated and fixed within the outer member;
- an inner member with a through-hole extending from an upper end to a lower end of the inner member, the inner member including:
  - a head located outside the outer member; and
  - a rod partially received in the outer member, including:
    - a shoulder abutting against the elastic member; and
    - a spoon-shaped portion provided at the end of the rod remote from the head; and
- a guiding and limiting structure including:
  - a guiding and limiting groove; and
  - a protrusion received in the guiding and limiting groove to slide along the guiding and limiting groove,
- wherein one of the protrusion and the guiding and limiting groove is arranged on an inner wall of the outer member and another of the protrusion and the guiding and limiting groove is arranged on a sidewall of the rod of the inner member, when the protrusion is at a low position of the guiding and limiting groove, the spoon-shaped portion is extended out of the outer member, and when the protrusion is at a high position of the guiding and limiting groove, the spoon-shaped portion is retracted into the outer member.

In an embodiment, the outer member is provided with a stepped hole extending from an upper end surface to a lower end surface of the outer member; the elastic member is retained within the stepped hole with one end abutting against a step of the stepped hole; the rod of the inner member is partially received in the stepped hole and the elastic member.

In an embodiment, the rod includes:

- an upper rod segment connected to the head and having a sidewall, the another of the protrusion and the guiding and limiting groove being arranged on the sidewall of the upper rod segment, the guiding and limiting groove including an open groove and a closed groove communicating with the open groove, the open groove having an opening for the protrusion to enter the guiding and limiting groove; and
- a lower rod segment, the shoulder being formed between the upper rod segment and the lower rod segment.

In an embodiment, the stepped hole includes an upper larger hole and a lower smaller hole, and the step is formed between the upper larger hole and the lower smaller hole; the upper rod segment has a larger diameter than the lower rod segment.

In an embodiment, the protrusion is arranged on a sidewall of the stepped hole; the guiding and limiting groove is arranged on the sidewall of the upper rod segment; and the opening of the open groove is formed on the shoulder.

In an embodiment, the guiding and limiting groove is arranged on a sidewall of the stepped hole; the protrusion is arranged on the sidewall of the upper rod segment; and the opening of the open groove is formed on the upper end surface of the outer member.

In an embodiment, the outer member includes a head, the head of the outer member includes an upper end surface, a lower end surface and a sidewall connecting the upper end surface and the lower end surface, the upper end surface and the lower end surface are opposite to each other and identical to each other in shape, each of the upper end surface and the lower end surface is an annular surface with an outer perimeter defining a shape of a regular polygon, the sidewall includes: first triangular surfaces extending downward and outward from each side of the upper end surface, second triangular surfaces extending upward and outward from each side of the lower end surface, and diamond-shaped surfaces, each first triangular surface and a corresponding second triangular surface share a vertice, a diamond-shaped surface is formed between each two adjacent vertices, and four edges of the diamond-shaped surface includes two edges of two adjacent first triangular surfaces and two edges of two adjacent second triangular surfaces.

In an embodiment, the outer member further includes a main body connected to the head of the outer member, the main body includes an upper end connected to the head and a lower end remote from the head, the main body having a regular pentagon cross-section at any position perpendicular to a central axis of the stepped hole, centers of all regular polygon cross-sections are located on the central axis of the stepped hole, starting from the lower end surface of the head of the outer member, each regular polygon cross-section is decreased in size compared to an adjacent upper regular pentagon cross-section, and within a plane perpendicular to the central axis of the stepped hole, each regular polygon cross-section is rotated clockwise or counterclockwise relative to the adjacent upper regular pentagon cross-section by a preset angle.

In an embodiment, the main body includes a plurality of outer side surfaces extending from the upper end to the lower end, each outer side surface is formed by sides of the regular pentagon cross-sections, at least one of the outer side surfaces is provided with a hole, and the hole is located at the lower end and communicating with the stepped hole.

The present application also provides a necklace, which includes:

the multifunctional pendant as mentioned above; and a chain including a loop sleeved on the rod.

In addition to serving as a pendant for a necklace, the multifunctional pendant provided by the embodiments of the present application can have the spoon-shaped portion at the lower end of the inner member extended out by pressing the inner member. The cooperation between the transverse groove on the inner member and the protrusion can prevent the spoon-shaped portion from retracting into the stepped hole. A cotton wick or other material soaked with perfume can be placed in the through-hole of the inner member. Then the spoon-shaped portion can be retracted into the stepped hole. The spoon-shaped portion prevents the cotton wick or other perfumed material from falling out, and the multifunctional pendant thus can serve as a perfume holder. Additionally, the holes provided on the outer side surface of the lower end of the main body of the outer member communicate with the through-hole of the inner member, facilitating the fragrance of the perfume to waft out. Furthermore, without the cotton wick or other perfumed material in the through-hole, the spoon-shaped portion at the lower end of the inner member can be used as a spoon to scoop food or medicine. After the spoon-shaped portion is retracted into the stepped hole, the inner member of the multifunctional pendant can function as a straw, serving as an emergency response tool. Therefore, the multifunctional pendant provided in the embodiments of this application expands the uses of the pendant and facilitates users.

DETAILED DESCRIPTION OF THE EMBODIMENTS

Figure 1:
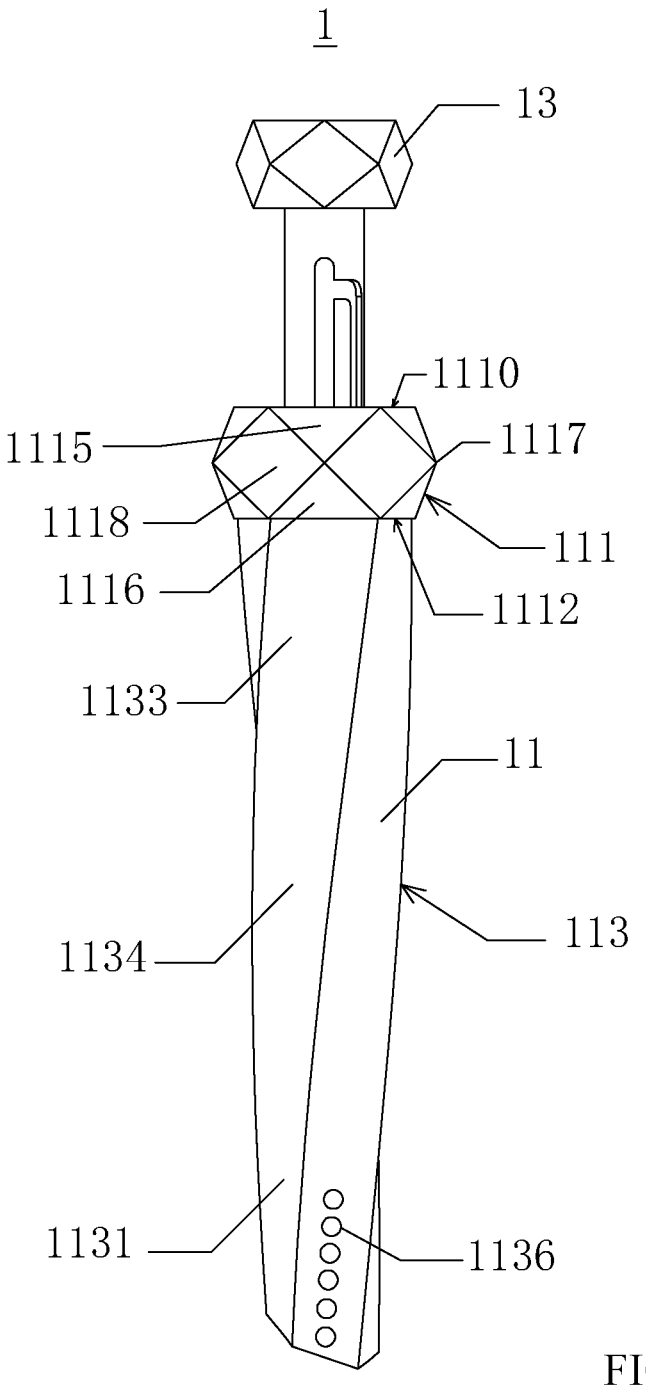
FIG. 1 is a schematic structural view of a multifunctional pendant according to an embodiment of the present disclosure.
Figure 2:
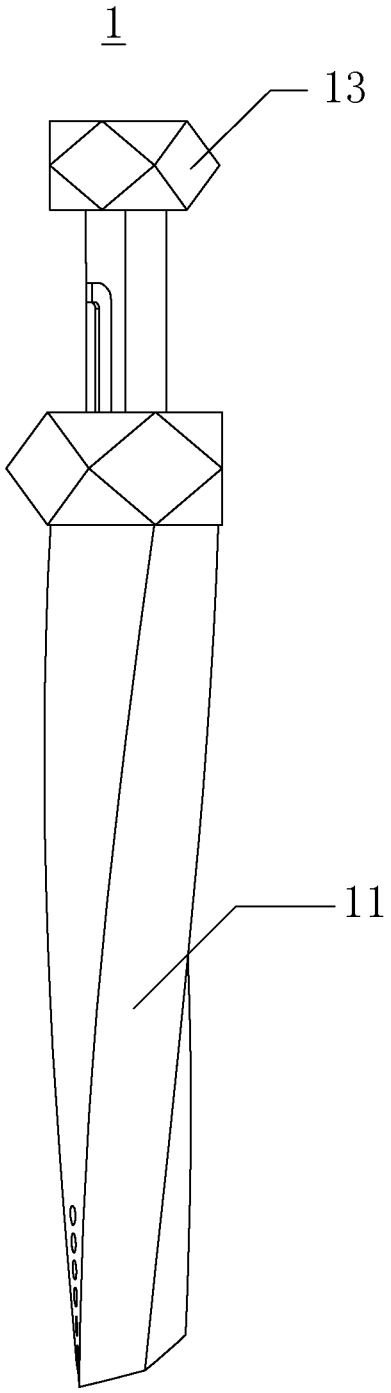
FIG. 2 is another schematic structural view of the multifunctional pendant of FIG. 1.
Figure 3:
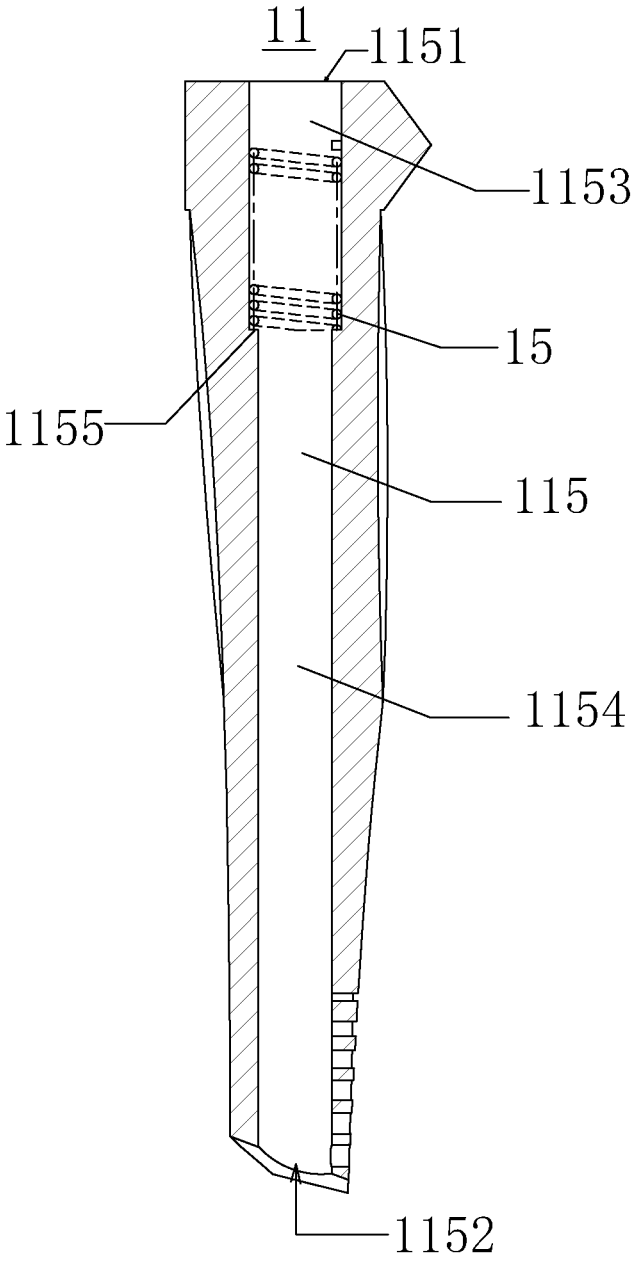
FIG. 3 is a schematic cross-sectional view of an outer member of the multifunctional pendant of FIG. 1.

The following describes the embodiments of the present application in detail with reference to the figures.

Referring to FIGS. 1 to 4, a multifunctional pendant 1 provided in an embodiment of the present application includes an outer member 11 and an inner member 13. Both the outer member 11 and the inner member 13 are strip-shaped. The outer member 11, along its length direction, includes a head 111 and a main body 113 located below the head 111 and connected to the head 111. A stepped hole 115 is formed inside the outer member 11. The stepped hole 115 is extended from the head 111 to the main body 113, and includes a first opening 1151 on an upper end surface 1110 of the head 111 and a second opening 1152 at a lower end 1131 of the main body 113. In an embodiment, the second opening 1152 is located on a bottom end surface of the lower end 1131 of the main body 113, and the first opening 1151 is located at a central position of the upper end surface 1110.

In this embodiment, the stepped hole 115 includes an upper larger hole 1153 with a relatively larger diameter and a lower smaller hole 1154 with a relatively smaller diameter. The upper larger hole 1153 and the lower smaller hole 1154 are cylindrical holes coaxially arranged. Central axes of the upper larger hole 1153 and the lower smaller hole 1154 are a central axis of the stepped hole 115, and the central axis of the stepped hole 115 is substantially straight. A step 1155 is formed between the upper larger hole 1153 and the lower smaller hole 1154. An elastic member 15 is retained within the outer member 11, and a lower end of the elastic member 15 abuts against the step 1155.

In this embodiment, the multifunctional pendant 1 further includes a guiding and limiting structure 17 and the guiding and limiting structure 17 includes a protrusion 171. In this embodiment, the protrusion 171 is formed on a sidewall of the upper larger hole 1153, and located above the elastic member 15. In this embodiment, the elastic member 15 is a spring.

The head 111 includes an upper end surface 1110, a lower end surface 1112 opposite to the lower end surface, and a sidewall 1114 connecting the upper end surface 1110 and the lower end surface 1112. In this embodiment, each of the upper end surface 1110 and the lower end surface 1112 is an annular surface with an outer perimeter defining a shape of a regular pentagon. Corners of the upper end surface 1110 are in one-to-one alignment with those of the lower end surface 1112, and edges of the upper end surface 1110 are in one-to-one alignment with those of the lower end surface 1112. In this embodiment, the sidewall 1114 includes multiple types of regions, which includes first triangular regions 1115 extending downward and outward from each edge of the upper end surface 1110, and second triangular regions 1116 extending upward and outward from each edge of the lower end surface 1112. Each first triangular region 1115 and its corresponding second triangular region 1116 share a vertice which is also a vertice 1117 of the sidewall. A rhombic region 1118 is formed between every two adjacent vertices 1117 with the two adjacent vertices 1117 as its diagonal vertices, thus, four edges of the rhombic region 1118 includes two edges of two adjacent first triangular regions 1115 and two edges of two adjacent second triangular regions 1116.

Figure 8:
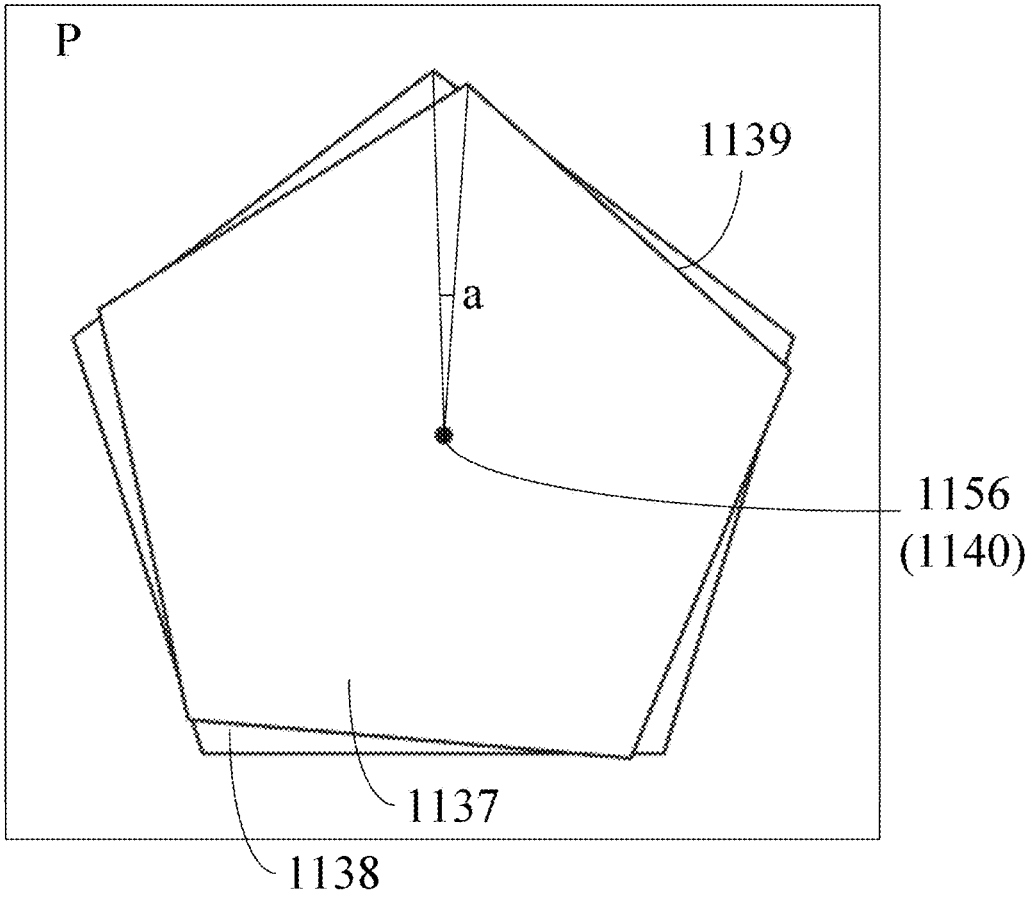
FIG. 8 shows cross-sections of a main body of the outer member of the multifunctional pendant of FIG. 1.

The main body 113 includes the lower end 1131 away from the head 111, an upper end 1133 connected to the head 111, and a plurality of outer side surfaces 1134. Referring to FIG. 8, the main body 113 has a regular pentagon cross-section at any position perpendicular to the central axis of the stepped hole 115, and centers 1140 of all regular pentagon cross-sections are located on the same straight line, for example, the centers of all regular pentagon cross-sections are located on the central axis 1156 of the stepped hole 115. Starting from the lower end surface 1112 of the head 111, each regular pentagon cross-section 1137 of the main body 113 is decreased in size compared to an adjacent upper regular pentagon cross-section 1138, and within a plane P perpendicular to the central axis 1156 of the stepped hole 115, rotated clockwise (or counterclockwise) relative to the adjacent upper regular pentagon cross-section 1138 by a preset angle a. Vertices of the regular pentagon cross-sections of the main body 113 from top to bottom are connected to form edges 1135. Therefore, the main body 113 has five edges 1135 that gradually approach the central axis of the stepped hole 115 from top to bottom and simultaneously rotate a certain angle around the central axis.

Each outer side surface 1131 is formed by sides 1139 of the regular pentagon cross-section 1137 of the main body 113 from top to bottom and is located between two adjacent edges 1135. At least one outer side surface 1131 is provided with a hole 1136. The hole 1136 is positioned at the lower end 1131 and communicates with the stepped hole 115. In this embodiment, there are multiple holes 1136 arranged in a row.

The regular pentagons are taken as examples to form the shape of the outer member 11 in the above. However, it can be understood that in other embodiments, regular polygons other than pentagons, such as regular triangles, squares, regular hexagons, or regular heptagons, can be adopted to form the outer profile of the outer member 11.

The inner member 13 is received in the stepped hole 115 of the outer member 11 and includes a head 131 and a rod 133. The head 131 is located outside the stepped hole 115, and the rod 133 is connected to the head 131. A length of the rod 133 is longer than that of the stepped hole 115. As a result, a portion of the rod 133 is outside of the outer member 11 after the inner member 13 is received in the outer member 11. In this embodiment, the head 131 is generally identical in shape to the head 111 of the outer member 11, but smaller in size. The rod 133 includes an upper rod segment 1330 with a larger diameter and a lower rod segment 1331 with a smaller diameter. The upper rod segment 1330 is located between the head 131 and the lower rod segment 1331. In this embodiment, both the upper rod segment 1330 and the lower rod segment 1331 are cylindrical. A shoulder 1332 is formed between the upper rod segment 1330 and the lower rod segment 1331, and is abutted against an upper end of the elastic member 15.

Figure 4:
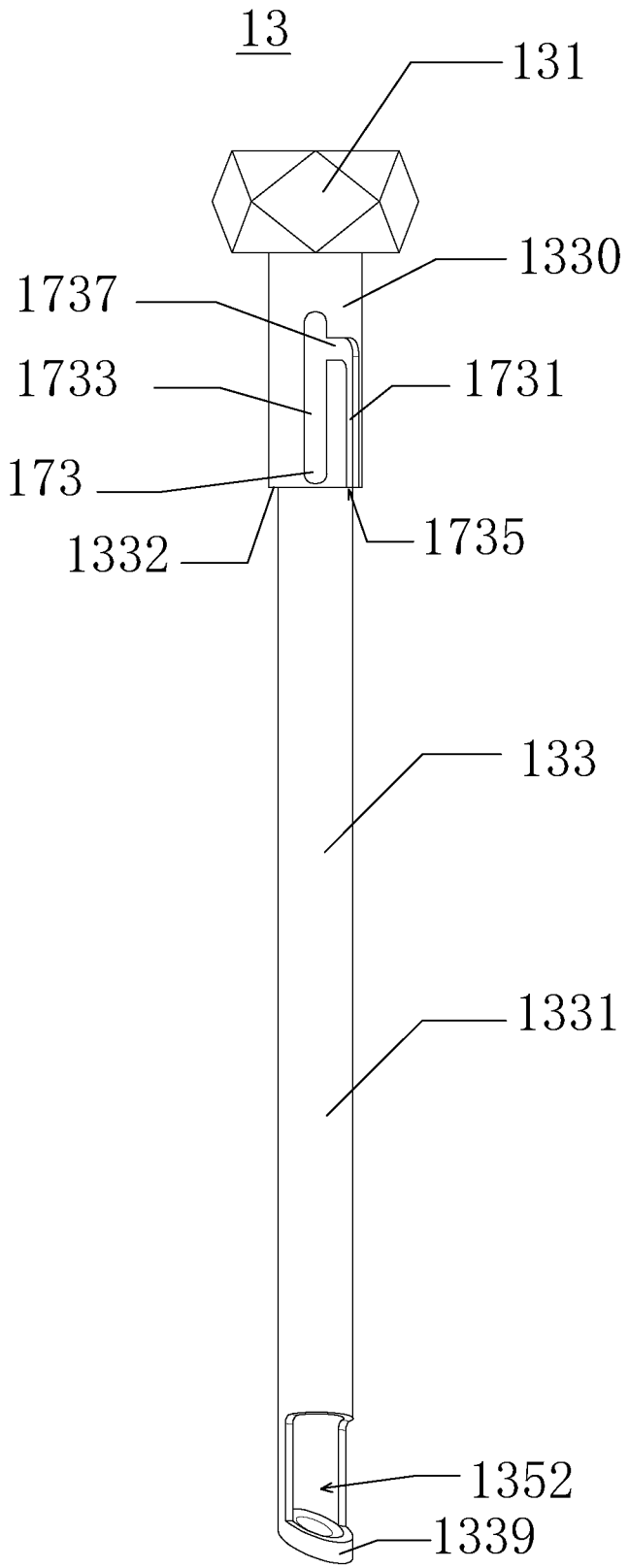
FIG. 4 is a schematic structural view of an inner member of the multifunctional pendant of FIG. 1.

Referring to FIG. 4, the guiding and limiting structure 17 further includes a guiding and limiting groove 173. In this embodiment, the guiding and limiting groove 173 is located on a sidewall 1333 of the upper rod segment 1330. The guiding and limiting groove 173 is paired with the protrusion 171 on the sidewall of the upper larger hole 1153 of the outer member 11. After the inner member 13 is received in the outer member 11, the inner member 13 and the outer member 11 are engaged to prevent the inner member 13 from disengaging from the outer member 11. In this embodiment, the guiding and limiting groove 173 is generally h-shaped, and includes an open groove 1731 and a closed groove 1733. The open groove 1731 refers to a sliding groove through which the protrusion 171 enters the guiding and limiting groove 173. This sliding groove has an opening 1735 at the shoulder 1332 where the upper rod segment 1330 meets the lower rod segment 1331, and the opening 1735 is for the protrusion 171 to enter the guiding and limiting groove 173. The closed groove 1733 refers to a sliding groove that does not provide an opening for the protrusion 171 to enter the guiding and limiting groove 173. In other words, the closed groove 1733 is a sliding groove without a downward-facing opening. In other embodiments, the guiding and limiting groove 173 may be n-shaped, m-shaped, or inverted J-shaped. The shape of the guiding and limiting groove 173 is not limited, as long as it has at least one open groove 1731 and at least one closed groove 1733.

Figure 5:
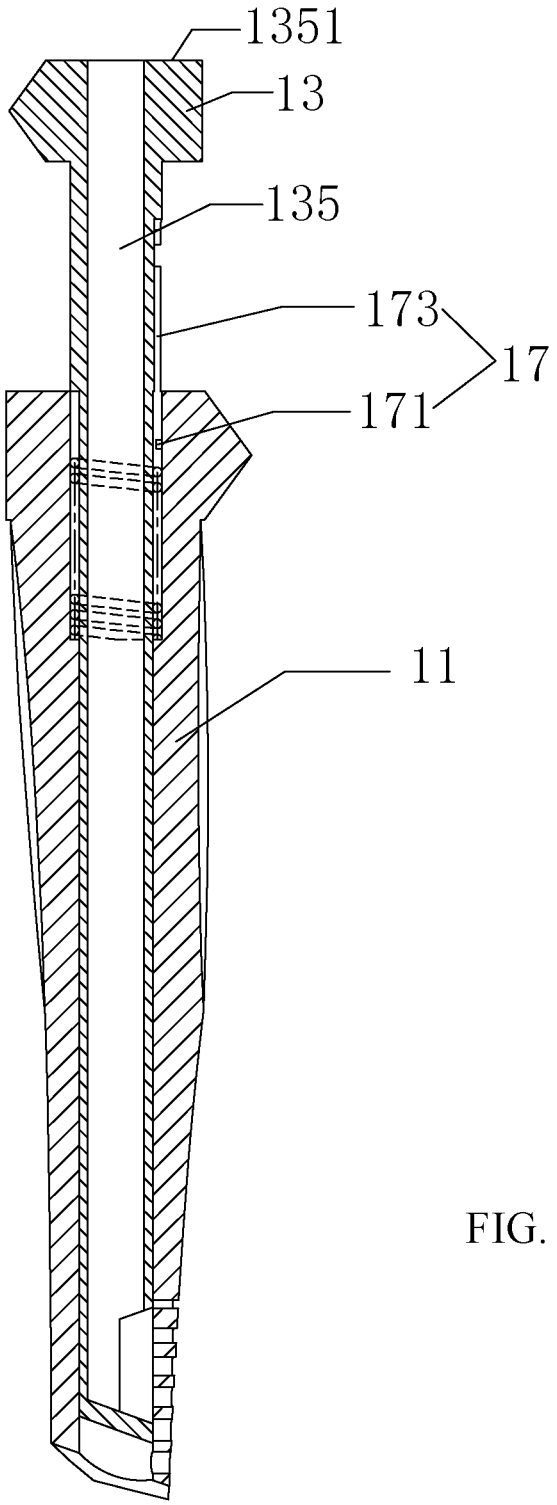
FIG. 5 is a schematic cross-sectional view of the multifunctional pendant of FIG. 1.

Referring to FIG. 5, a through-hole 135 is formed on the inner member 13 and has an opening 1351 on an upper end surface of the head 131 and a notch 1352 on a sidewall of a lower end of the lower rod segment 1331. The presence of the notch 1352 results in the formation of a spoon-shaped portion 1339 at the lower end of the lower rod segment 1331. In one embodiment, a bottom of the lower rod segment 1331 and the sidewall connected to the bottom cooperates to form the spoon-shaped portion 1339. In another embodiment, the bottom of the lower rod segment 1331 is penetrated by the through-hole 135, and the sidewall at the lower end of the lower rod segment is bent toward the through-hole 135 to form the spoon-shaped portion 1339.

After the inner member 13 is inserted into the outer member 11 through the first opening 1151 of the head 111 of the outer member 11, the opening 1735 of the open groove 1731 of the guiding and limiting groove 173 can be aligned with the protrusion 171. The protrusion 171 enters the guiding and limiting groove 173 through the opening 1735, the inner member 13 can be further pushed against the elastic member 15, and the protrusion 171 continues to move upward along the open groove 1731 until it reaches the top of the open groove 1731. Then the inner member 13 can be rotated to move the protrusion 171 to the transverse groove 1737 that connects the open groove 1731 and the closed groove 1733. After the protrusion 171 is located within the transverse groove 1737, the spoon-shaped portion 1339 at the lower end of the inner member 13 is extended out of the stepped hole 115. The inner member 13 is further rotated to move the protrusion 171 to the closed groove 1733. After the protrusion 171 is located in the closed groove 1733, the inner member 13 is pushed by the elastic member 15 and moved upward toward an upper end of the outer member 11 until the protrusion 171 abuts against a lower end of the closed groove 1733. The spoon-shaped portion 1339 is then received within the stepped hole 115. When to disassemble the inner member 13 from the outer member 11, the inner member 13 can be pressed downward to move the protrusion 171 to align with the transverse groove 1737. The inner member 13 can be rotated to move the protrusion 171 into the transverse groove 1737 and then into the open groove 1731. After the protrusion 171 enters the open groove 1731, the inner member 13 can be taken away from the outer member 11.

In another embodiment, the guiding and limiting groove 173 is provided on the sidewall of the stepped hole 115. The opening 1735 of the open groove 1731 of the guiding and limiting groove 173 is provided on the upper end surface 1110 of the head 111 of the outer member 11, and the protrusion 171 is provided on the sidewall of the inner member 13.

In summary, the multifunctional pendant provided by the embodiments of the present application includes an outer member 11, an elastic member 15 received and fixed in the outer member 11, an inner member 13 with a through-hole 135, and a guiding and limiting structure 17. The inner member 13 includes a head 131 located outside the outer member 11 and a rod 133 partially received in the outer member 11. The rod 133 has a shoulder 1332 that abuts against the elastic member 15, and a spoon-shaped portion 1339 provided at an end of the rod 133 away from the head 131. The guiding and limiting structure 17 includes a guiding and limiting groove 173 and a protrusion 171. One end of the protrusion 171 is received in the guiding and limiting groove 173 to slide along the guiding and limiting groove 173. One of the protrusion 171 and the guiding and limiting groove 173 is provided on an inner wall of the outer member 11, and the other is provided on a sidewall of the rod 133. After the protrusion 171 is moved to a higher position (such as the transversal groove) of the guiding and limiting groove 173, the spoon-shaped portion 1339 is extended out of the outer member 11. After the protrusion 171 is moved to a lower position (such as the lower end of the closed groove 1733) of the guiding and limiting groove 173, the spoon-shaped portion 1339 is retracted into the outer member 11.

Figure 7:
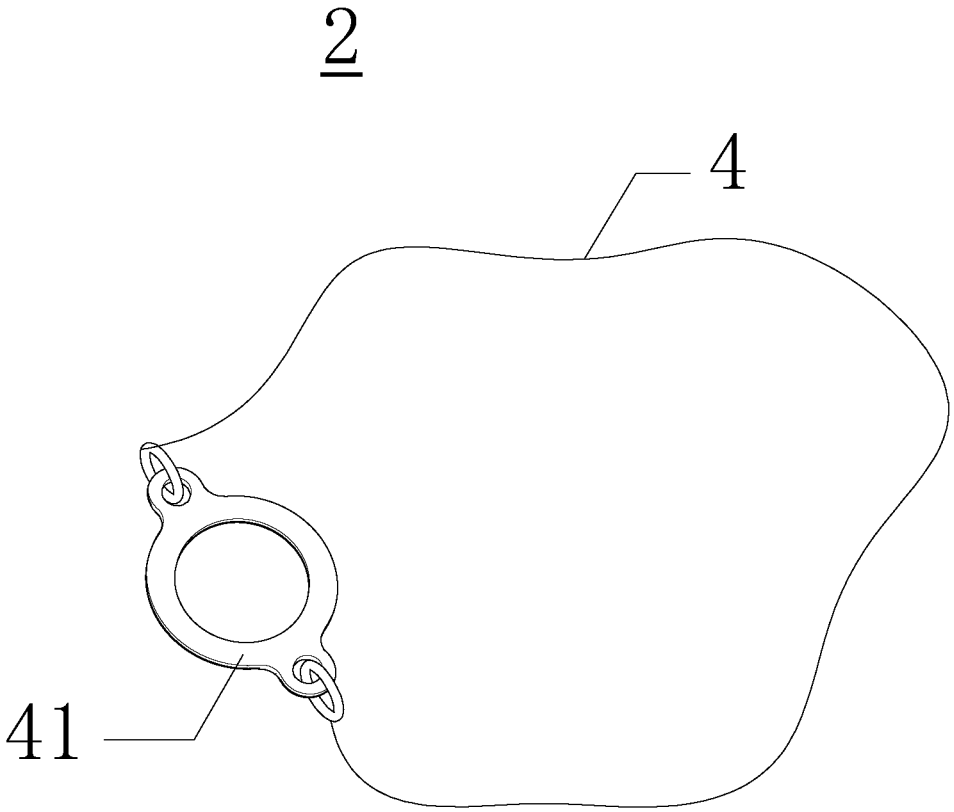
FIG. 7 is a schematic structural view of a chain according to an embodiment of the present application.

Since the inner member 13 and the outer member 11 are detachable, a loop 41 of a chain 4 (referring to FIG. 7) can be sleeved onto the rod 133 of the inner member 13. Then the inner member 13 can be inserted into the outer member 11 and fixed by the outer member 11, and a necklace 2 with the multifunctional pendant 1 and the chain 4 is obtained. In addition to serving as a pendant for a necklace, the multifunctional pendant 1 provided by the embodiments of the present application can have the spoon-shaped portion 1339 at the lower end of the inner member 13 extended out by pressing the inner member 13. The cooperation between the transverse groove 1737 on the inner member 13 and the protrusion 171 can prevent the spoon-shaped portion 1339 from retracting into the stepped hole 115. A cotton wick or other material soaked with perfume can be placed in the through-hole 135 of the inner member 13. Then the spoon-shaped portion 1339 can be retracted into the stepped hole 115. The spoon-shaped portion 1339 prevents the cotton wick or other perfumed material from falling out, and the multifunctional pendant 1 thus can serve as a perfume holder. Additionally, the holes 1136 provided on the outer side surface of the lower end of the main body 113 of the outer member 11 communicate with the through-hole 135 of the inner member 13, facilitating the fragrance of the perfume to waft out. Furthermore, without the cotton wick or other perfumed material in the through-hole 135, the spoon-shaped portion 1339 at the lower end of the inner member 13 can be used as a spoon to scoop food or medicine. After the spoon-shaped portion 1339 is retracted into the stepped hole 115, the inner member 13 of the multifunctional pendant 1 can function as a straw, serving as an emergency response tool.

Figure 6:
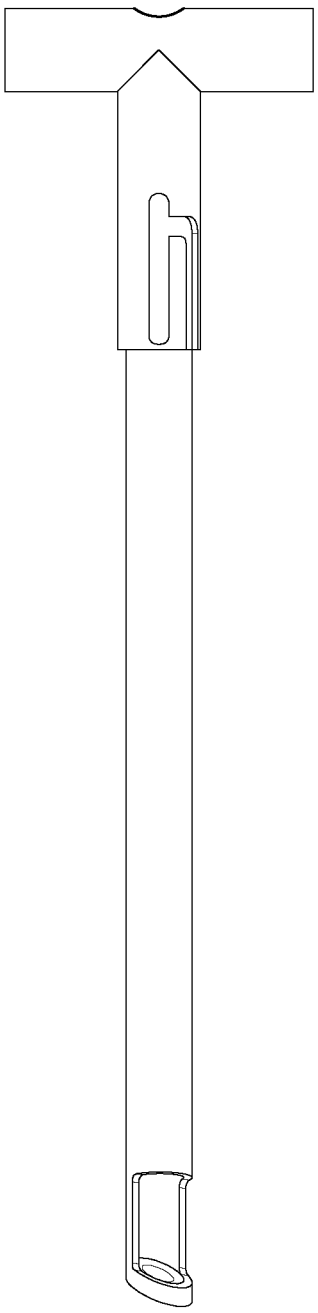
FIG. 6 is a schematic structural view of the inner member according to another embodiment.

Moreover, due to the special shape design of the head 111 and the main body 113 of the outer member 11, as well as the special shape design of the head of the inner member 13, the multifunctional pendant 1 provided by the embodiments of the present application has an aesthetically pleasing appearance. Referring to FIG. 6, in another embodiment, the head 131 of the inner member 13 is a cylinder, and the cylinder is orthogonal to the rod 133.

Unless the statement and limitation are explicitly given in the description of the present utility, the terms "mounting," and "connection" should be construed broadly, and may be, for example, a fixed connection, a detachable connection, or an integral connection, and can be a mechanical connection or an electrical connection, and can be a direct connection or an indirect connection made through an intermediate medium, and can be a communication between two elements. The specific meaning of the above terms in the present application will be understood in specific cases by those of ordinary skill in the art.

It will be evident to those skilled in the art that the application is not limited to the details of the foregoing illustrative embodiments, and that the present application may be embodied in other specific forms without departing from the spirit or essential characteristics thereof. The present embodiments are, therefore, to be considered in all respects as illustrative and not restrictive. The scope of the application being indicated by the claims rather than by the foregoing description, and all changes which come within the meaning and range of the equivalents of the claims are therefore intended to be included therein. Any reference sign in a claim should not be construed as limiting the claim.

Furthermore, it should be understood that although the present disclosure is described by embodiments, not every embodiment is provided with only one separate solution. This description is provided for clarity only, the disclosure should be taken as a whole, and other embodiments can be apparent to those skilled in the art by combining embodiments, which are described as examples, appropriately.

What is claimed is:

1. A multifunctional pendant, comprising:
- an outer member;
- an elastic member accommodated and fixed within the outer member;
- an inner member with a through-hole extending from an upper end to a lower end of the inner member, the inner member comprising:
  - a head located outside the outer member; and
  - a rod partially received in the outer member, comprising:
    - a shoulder abutting against the elastic member; and
    - a spoon-shaped portion provided at an end of the rod remote from the head; and
- a guiding and limiting structure comprising:
  - a guiding and limiting groove; and
  - a protrusion received in the guiding and limiting groove to slide along the guiding and limiting groove,
  - wherein one of the protrusion and the guiding and limiting groove is arranged on an inner wall of the outer member and another of the protrusion and the guiding and limiting groove is arranged on a sidewall of the rod of the inner member, when the protrusion is at a higher position of the guiding and limiting groove, the spoon-shaped portion is extended out of the outer member, and when the protrusion is at a lower position of the guiding and limiting groove, the spoon-shaped portion is retracted into the outer member.

2. The multifunctional pendant according to claim 1, wherein,
- the outer member is provided with a stepped hole extending from an upper end surface to a lower end surface of the outer member;
- the elastic member is retained within the stepped hole with one end abutting against a step of the stepped hole;
- the rod of the inner member is partially received in the stepped hole and the elastic member.

3. The multifunctional pendant according to claim 2, wherein the rod comprises:
- an upper rod segment connected to the head and having a sidewall, the another of the protrusion and the guiding and limiting groove being arranged on the sidewall of the upper rod segment, the guiding and limiting groove including an open groove and a closed groove communicating with the open groove, the open groove having an opening for the protrusion to enter the guiding and limiting groove; and
- a lower rod segment, wherein the shoulder is formed between the upper rod segment and the lower rod segment.

4. The multifunctional pendant according to claim 3, wherein,
- the stepped hole comprises an upper larger hole and a lower smaller hole, and the step is formed between the upper larger hole and the lower smaller hole;

the upper rod segment is larger in diameter than the lower rod segment.

5. The multifunctional pendant according to claim 4, wherein, the protrusion is arranged on a sidewall of the stepped hole;

the guiding and limiting groove is arranged on the sidewall of the upper rod segment; and the opening of the open groove is formed on the shoulder.

6. The multifunctional pendant according to claim 4, wherein, the guiding and limiting groove is arranged on a sidewall of the stepped hole;

the protrusion is arranged on the sidewall of the upper rod segment; and the opening of the open groove is formed on the upper end surface of the outer member.

7. The multifunctional pendant according to claim 2, wherein the outer member comprises:

a head, the head of the outer member comprising:

an upper end surface being an annular surface with an outer perimeter defining a shape of a regular polygon, a lower end surface having an annular shape with an outer perimeter defining a shape of a regular polygon being located opposite to the upper end surface of the outer member and having an identical outer perimeter shape as the outer perimeter shape of the upper end surface of the outer member; and a sidewall connecting the upper end surface and the lower end surface of the outer member, the sidewall of the head of the outer member comprising:

first triangular surfaces extending downward and outward from each side of the upper end surface of the head of the outer member;

second triangular surfaces extending upward and outward from each side of the lower end surface of the head of the outer member; and diamond-shaped surfaces, wherein each first triangular surface and a corresponding second triangular surface share a vertice, a diamond-shaped surface is formed between each two adjacent vertices, and four edges of the diamond-shaped surface comprises two edges of two adjacent first triangular surfaces and two edges of two adjacent second triangular surfaces.

8. The multifunctional pendant according to claim 7, wherein the outer member further comprises:

a main body connected to the head of the outer member, the main body comprising:

an upper end connected to the head of the outer member; and a lower end remote from the head of the outer member, wherein the main body has a regular pentagon cross-section at any position perpendicular to a central axis of the stepped hole, centers of all regular polygon cross-sections are located on the central axis of the stepped hole, starting from the lower end surface of the head of the outer member, each regular polygon cross-section is decreased in size compared to an adjacent upper regular pentagon cross-section, and within a plane perpendicular to the central axis of the stepped hole, each regular polygon cross-section is rotated clockwise or counterclockwise relative to the adjacent upper regular pentagon cross-section by a preset angle.

9. The multifunctional pendant according to claim 8, wherein the main body comprises a plurality of outer side surfaces extending from the upper end to the lower end, each outer side surface is formed by sides of the regular pentagon cross-sections, at least one of the outer side surfaces is provided with a hole, and the hole is located at the lower end and communicating with the stepped hole.

10. A necklace, comprising:

a multifunctional pendant, comprising:

an outer member;

an elastic member accommodated and fixed within the outer member;

an inner member with a through-hole extending from an upper end to a lower end of the inner member, the inner member comprising:

a head located outside the outer member; and a rod partially received in the outer member, comprising:

a shoulder abutting against the elastic member; and a spoon-shaped portion provided at an end of the rod remote from the head; and a guiding and limiting structure comprising:

a guiding and limiting groove; and a protrusion received in the guiding and limiting groove to slide along the guiding and limiting groove, wherein one of the protrusion and the guiding and limiting groove is arranged on an inner wall of the outer member and another of the protrusion and the guiding and limiting groove is arranged on a sidewall of the rod of the inner member, when the protrusion is at a higher position of the guiding and limiting groove, the spoon-shaped portion is extended out of the outer member, and when the protrusion is at a lower position of the guiding and limiting groove, the spoon-shaped portion is retracted into the outer member; and a chain including a loop sleeved on the rod.

11. The necklace according to claim 10, wherein, the outer member is provided with a stepped hole extending from an upper end surface to a lower end surface of the outer member;

the elastic member is retained within the stepped hole with one end abutting against a step of the stepped hole;

the rod of the inner member is partially received in the stepped hole and the elastic member.

12. The necklace according to claim 11, wherein the rod comprises:

an upper rod segment connected to the head and having a sidewall, the another of the protrusion and the guiding and limiting groove being arranged on the sidewall of the upper rod segment, the guiding and limiting groove including an open groove and a closed groove communicating with the open groove, the open groove having an opening for the protrusion to enter the guiding and limiting groove; and a lower rod segment, wherein the shoulder is formed between the upper rod segment and the lower rod segment.

13. The necklace according to claim 12, wherein, the stepped hole comprises an upper larger hole and a lower smaller hole, and the step is formed between the upper larger hole and the lower smaller hole;

the upper rod segment is larger in diameter than the lower rod segment.

14. The necklace according to claim 13, wherein, the protrusion is arranged on a sidewall of the stepped hole;

the guiding and limiting groove is arranged on the sidewall of the upper rod segment; and the opening of the open groove is formed on the shoulder.

15. The necklace according to claim 13, wherein, the guiding and limiting groove is arranged on a sidewall of the stepped hole;

the protrusion is arranged on the sidewall of the upper rod segment; and the opening of the open groove is formed on the upper end surface of the outer member.

16. The necklace according to claim 11, wherein the outer member comprises:

a head, the head of the outer member comprising:

an upper end surface being an annular surface with an outer perimeter defining a shape of a regular polygon, a lower end surface having an annular shape with an outer perimeter defining a shape of a regular polygon being located opposite to the upper end surface of the outer member and having an identical outer perimeter shape as the outer perimeter shape of the upper end surface of the outer member; and a sidewall connecting the upper end surface and the lower end surface of the outer member, the sidewall of the head of the outer member comprising:

first triangular surfaces extending downward and outward from each side of the upper end surface of the head of the outer member;

second triangular surfaces extending upward and outward from each side of the lower end surface of the head of the outer member; and diamond-shaped surfaces, wherein each first triangular surface and a corresponding second triangular surface share a vertice, a diamond-shaped surface is formed between each two adjacent vertices, and four edges of the diamond-shaped surface comprises two edges of two adjacent first triangular surfaces and two edges of two adjacent second triangular surfaces.

17. The necklace according to claim 16, wherein the outer member further comprises:

a main body connected to the head of the outer member, the main body comprising:

an upper end connected to the head of the outer member; and a lower end remote from the head of the outer member, wherein the main body has a regular pentagon cross-section at any position perpendicular to a central axis of the stepped hole, centers of all regular polygon cross-sections are located on the central axis of the stepped hole, starting from the lower end surface of the head of the outer member, each regular polygon cross-section is decreased in size compared to an adjacent upper regular pentagon cross-section, and within a plane perpendicular to the central axis of the stepped hole, each regular polygon cross-section is rotated clockwise or counterclockwise relative to the adjacent upper regular pentagon cross-section by a preset angle.

18. The necklace according to claim 17, wherein the main body comprises a plurality of outer side surfaces extending from the upper end to the lower end, each outer side surface is formed by sides of the regular pentagon cross-sections, at least one of the outer side surfaces is provided with a hole, and the hole is located at the lower end and communicating with the stepped hole.

* * * * *